United States Patent [19]

Shoji et al.

[11] 4,055,963

[45] Nov. 1, 1977

[54] HEATING SYSTEM

[75] Inventors: Kunihiro Shoji; Akihiro Yokota; Kenzo Watanabe, all of Kusatsu, Japan

[73] Assignee: Daikin Kogyo Co., Ltd., Japan

[21] Appl. No.: 590,203

[22] Filed: June 25, 1975

[51] Int. Cl.[2] ..... F25B 13/00

[52] U.S. Cl. ..... 62/238; 62/197; 62/324; 237/2 B

[58] Field of Search ..... 62/238, 324, 160, 197, 62/117, 196 B; 237/2 B; 165/29

[56] References Cited

U.S. PATENT DOCUMENTS

| | | | |
|---|---|---|---|
| 2,619,326 | 11/1952 | McLenegan | 62/238 X |
| 2,780,415 | 2/1957 | Gay | 237/2 B |
| 3,366,166 | 1/1968 | Gerteis | 165/29 |
| 3,777,508 | 12/1973 | Imabayash et al. | 62/324 |

*Primary Examiner*—William E. Wayner

*Attorney, Agent, or Firm*—Cushman, Darby & Cushman

[57] ABSTRACT

Improvements in a heating system which heats a fluid medium by a heat exchanger and delivers it to an indoor coil or coils for space heating. Refrigerant, such as fluorohydrocarbons for refrigerators, is utilized as the heating medium. The heat exchanger is supplied with heat from a heat source, such as hot water from a boiler, at a temperature higher than that of air around the exchanger. The refrigerant in liquid form is heated while being vaporized in the heat exchanger at a pressure greater than the saturation pressure corresponding to the ambient air temperature. The medium thus gasified to a high pressure and temperature is drawn into a circulating pump and then delivered to the indoor coil or coils, where it is condensed to a liquid with heat dissipation. In this way a great heating capacity is attained with the heating medium at a low rate of circulation. The suction of high-pressure heating medium enables the circulating pump of a small capacity to accomplish not only a high rate of transfer of the heating medium but also a decrease of the compression ratio. These beneficial effects combine to permit substantial reduction of the pump power consumption.

12 Claims, 6 Drawing Figures

HEATING SYSTEM

BACKGROUND OF THE INVENTION

The air conditioning systems that have hitherto been used most widely for performing both cooling and heating operations are those which include a cooling apparatus having a built-in electric heater or those which include a cooling apparatus having a built-in hot water coil. However, the former require high operation cost when the system performs a heating operation, while the latter, which depend on changes in water temperature or in sensible heat for the transfer of heat energy, require a high rate of heating medium circulation for their heating capacity. Consequently they need circulating pumps with large power consumption and large-diameter piping for the circulation of the heating medium. Another disadvantage is the cumbersomeness of pipework involved.

On the other hand, cooling and heating systems of the so-called heat pump type which utilize the ordinary refrigeration cycle are in use as installations taking advantage of changes in phase of the heating medium to receive and supply heat, thus carrying out the circulation of the medium at a low flow rate. The heat pump type equipment, which uses outdoor air as the heat source, has a limitation in that its heating capacity decreases as the outdoor air temperature drops. Since the tendency is that the lower the outdoor air temperature the greater the heating load requirement, the heat pump system offers a fatal disadvantage of insufficient heating capacity when it is very cold outdoors.

Moreover, since the conventional heat pump installations utilize outdoor air as the heat source and draw in the low-pressure refrigerant evaporated at a temperature level below the outdoor air temperature, the specific volume of the refrigerant vapor thus taken into a compressor that serves as the circulating pump is too large and the delivery is too small as compared with the cylinder volume. These shortcomings combine with a large pressure difference that occurs between the entrance and exit of the compressor to increase the power consumption of the compressor unduly for its heating capacity.

SUMMARY OF THE INVENTION

This invention has been perfected to settle the foregoing problems of the existing systems.

An object of this invention is to provide an air conditioning system wherein bypass circuit means are provided to outdoor coil means and expansion means for cooling operation which are components of a cooling circuit, and heat exchanger means adapted to heat refrigerant by a heat source higher in temperature than outdoor air is mounted on the suction side of the compressor means, so that when said bypass circuit means are opened, there is made a heating circuit of low resistance which is composed of the compressor means, indoor coil means and heat exchanger means, connected together through lines without the expansion means and wherein the use of said heating circuit enables the compressor means to perform a pumping operation without performing a compressing operation, whereby a novel heating operation can be performed with high capability and high efficiency.

Still another object of the invention is to provide a system which also comprises, in the vicinity of the exit of the heat exchanger, either a liquid separator or a superheating control valve for sensing the superheat of the refrigerant vapor drawn into the circulating pump and adjusting the rate of circulation to maintain the medium at a predetermined superheat, thereby protecting the circulating pump from drawing refrigerant liquid by suction and from any damage which may otherwise arise from liquid compression.

A further object of the invention is to provide a system capable of both cooling and heating operations, using a four-way valve as directional control means of the cooling and heating circuits for forward-backward switching of the flow direction of refrigerant, so that the circuitry is simplified and the directional control mechanism is made inexpensive.

Still a further object of the invention is to provide a system wherein, on the side of the outdoor coil, that serves as an entrance during heating operation, expansion means for heating operation is added and a bypass circuit is installed which allows the heating medium to bypass the heat exchanger during space heating, whereby the operation is selectively switched from the heating that depends on the heat exchanger for heat supply in accordance with the invention to the heating on a known heat pump cycle using outdoor air as the heat source, or vice versa; when the latter requires less running cost than the former, choice may be made for the heating operation on the heat pump principle.

An even further object of the invention is to provide a cooling and heating system divided into an outdoor unit comprising a compressor, heat exchanger, outdoor coil, and expansion means which operates in heating operation, and one or a plurality of indoor units each of which comprises an indoor coils one or a plurality of indoor units being connected to the outdoor unit through two lines for each indoor unit so that a cooling and heating system of the split type can be provided.

An additional object of the invention is to provide a cooling and heating system for a single room or a plurality of rooms, using as the heat source for a heat exchanger the water heated by a hot water boiler associated with a hot water supply circuit, so that the system can operate for space cooling or heating and hot water supply.

An additional object of the invention is to provide a system wherein resistor means is located between the heat exchanger means for heating the refrigerant and the outdoor coil means, such resistor means being adapted to provide an essentially minimum pressure differential to compressor means of the type which utilizes a pressure differential for the supply of lubricating oil, whereby the novel heating operation of this invention can be performed without any trouble and the aforementioned specific type of compressor means can be used.

DESCRIPTION OF THE PREFERRED EMBODIMENTS

Figure 1:
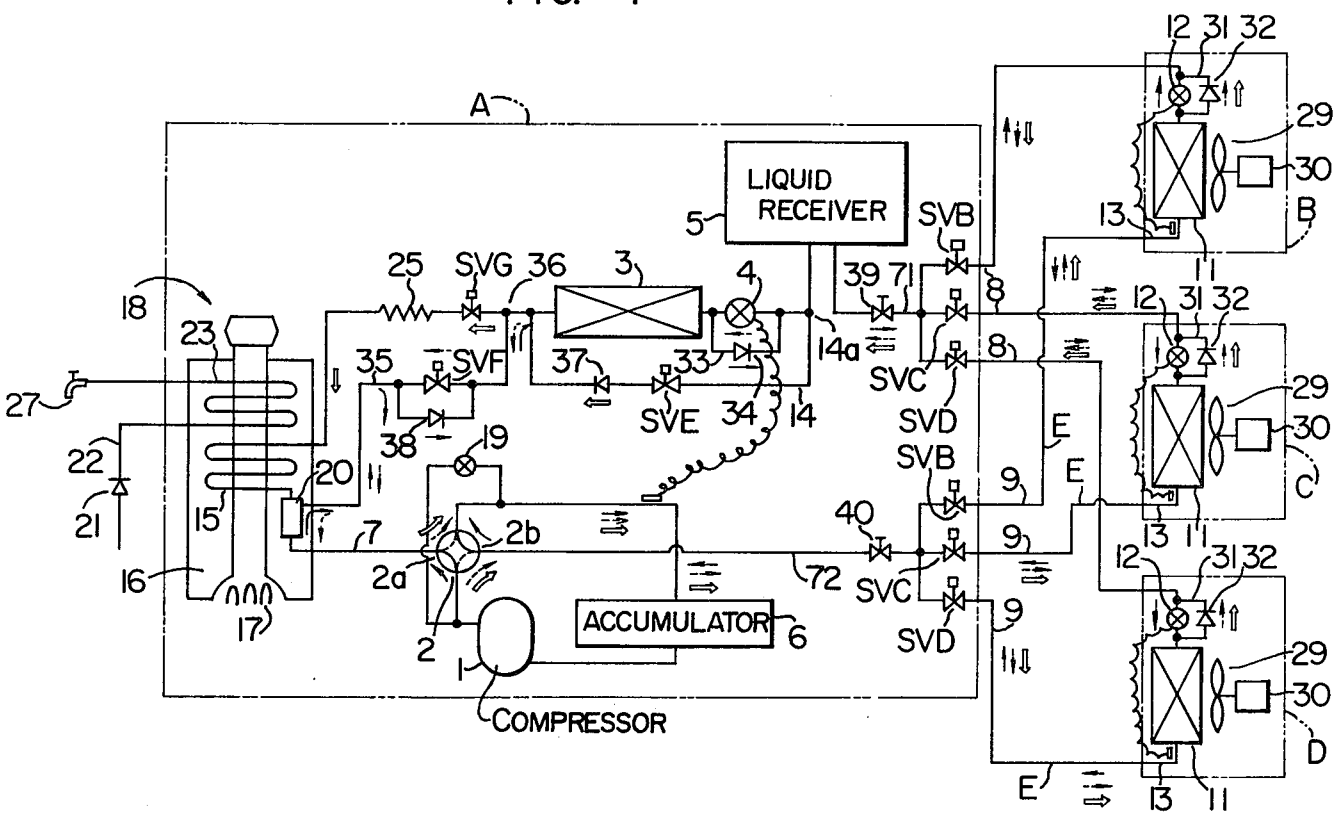
FIG. 1 is the piping diagram of a heating system embodying the present invention.

Referring first to FIG. 1, there is shown a combined cooling-heating system using fluorohydrocarbon gas, ammonia gas, or the like as the refrigerant. It is of a split type construction generally consisting of an outdoor unit A and three indoor units B, C, D intercommunicated by lines E for space cooling or heating as desired. The system is selectively operable for heating based on the novel concept of the invention or for conventional cooling or heating on the heat pump principle. In the figure, numeral 1 indicates a heating-medium circulating pump, in the form of a refrigerator compressor of a known design. 2 is a four-way valve, 3 is an outdoor coil, 4 is expansion means for heating operation, 5 is a liquid receiver, and 6 is an accumulator. These components are connected, in the order mentioned, by refrigerant line 7 between the intermediate ports 2*a* and 2*b* of the four-way valve 2.

On the refrigerant line 7, liquid line 71 is connected to three branch pipes 8 via a header, and gas line 72 is likewise connected to three branch pipes 9 via a header.

On the three liquid-side branch pipes 8 and three vapor-side branch pipes 9 are respectively installed six solenoid valves SVB, SVC, SVD, one for each. If these solenoid valves are of the reversible type, only three such valves may be employed for either group of vapor-side pipes 9 or liquid-side ones 8.

Each of the indoor units B, C, D connected to the outdoor unit A comprises an indoor coil 11 which serves as an evaporator during cooling operation and as a condenser when heating, expansion means 12 for cooling, a fan 29, and a fan motor 30, connected together by refrigerant pipes 13. The outdoor unit A and the indoor units B, C, D are intercommunicated by connector pipes E.

In FIG. 1, 31 is a first bypass circuit which allows the refrigerant to bypass each expansion means 12 during cooling operation, 32 is a check valve installed in the bypass circuit to permit the flow of the refrigerant from each indoor coil 11 to the liquid receiver 5 and interrupt the backward flow of the refrigerant, 33 is a third bypass circuit for bypassing the expansion means 4, and 34 is a check valve installed in the bypass circuit 33 to prevent the flow of the refrigerant from the liquid receiver 5 to the outdoor coil 3. Valves 39, 40 are provided for closing the liquid and vapor lines.

The construction described above is identical with that of a known cooling and heating system of the heat pump type. As the four-way valve 2 is controlled, either the outdoor coil 3 or indoor coils 11 serve as condensers to liquefy the refrigerant, the liquefied refrigerant is expanded to a low pressure by either expansion means 12 or 4 and then is evaporated by the indoor coils 11 or outdoor coil 3 serving as an evaporator, and finally the vaporized refrigerant is returned to the compressor 1. This refrigeration cycle is repeated forward or backward to carry out space cooling or heating. As already noted, the system during heating operation begins to fail to carry the heating load when the outdoor air temperature drops below a certain limit, although it works satisfactorily for cooling.

The present invention is directed to a cooling and heating system capable of performing space heating in a unique way. The system is based on the afore-described construction of the heat pump installation but is free from the disadvantage of decreasing heating capacity with declining outdoor air temperature. According to the invention, refrigerant is not flown through, but allowed to bypass, the outdoor coil 3 which serves as an evaporator during heating operation and also bypass the expansion means 12 that operates when cooling and the expansion means 4 that operates when heating. Next, the refrigerant liquefied in the indoor coils 11 is heated and evaporated by a heat exchanger 15 which uses a heat source at a temperature higher than the outdoor air temperature, without considerably reducing the pressure of the refrigerant as is the case with the conventional heat pump cycle. Then, the hot refrigerant is circulated through the compressor 1, indoor coils 11, heat exchanger, and again the compressor 1. The indoor coils 11 condense the refrigerant vapor and release the latent heat of condensation for the purpose of space heating. In the manner described, a closed circuit is formed in accordance with the invention. Its feature of particular importance is that the resistance of the circuit portion between the indoor coils 11 and the heat exchanger 15 is kept substantially unchanged without the use of an additional resistance as by the expansion means 4 or, if the resistance is to be increased, the system is so designed that the refrigerant pressure at the inlet of the heat exchanger 15 is not lower than the saturation pressure corresponding to the outdoor temperature prevailing when the system performs a heating operation, so that the liquid refrigerant is vaporized in the heat exchanger 15 at a pressure higher than the saturation pressure and then the high-pressure refrigerant is drawn into the compressor 1 by suction. This enables the compressor 1 to operate at unusually high pressure, draw in more refrigerant vapor or work with a lower compression ratio than do the conventional compressors of heat pump installations. Thus, in conformity with the invention, a small-capacity compressor is allowed to produce a fairly large heating capacity. This feature will more fully be explained below.

According to the present invention, the above-described refrigerant circuit for the refrigeration cycle includes a second bypass circuit 14 as branched therefrom at a branching point 14*a* to allow the refrigerant to bypass the outdoor coil 3 and expansion means 4 for heating operation. In this second bypass circuit 14 there are installed a solenoid valve SVE and a check valve 37 for interrupting the flow of the refrigerant from the four-way valve 2 to the liquid receiver 5. A heat exchanger 15 is included in the refrigerant line leading from the indoor coils 11 to the suction side of the compressor 1 via the second bypass circuit 14 or the outdoor coil 3. Therefore, opening the valve SVE will form a heated refrigerant circuit connecting the compressor 1, four-way valve 2, indoor coils 11 for heat exchange with indoor air, liquid receiver 5, second bypass circuit 14, heat exchanger 15 and again the four-way valve 2 and the compressor 1, in the order mentioned. As the heated refrigerant flowing through the circuit releases its heat via the indoor coils 11, space heating is realized.

Figure 4:
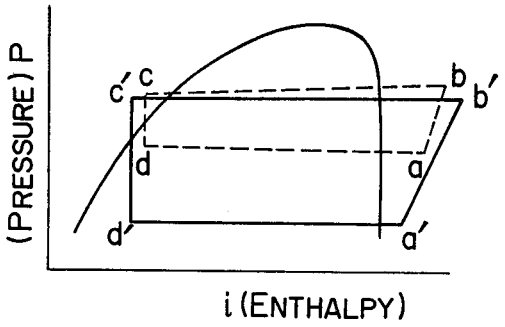

While the heat exchanger 15 is shown in FIG. 1 as installed at an intermediate point of the refrigerant line 7 between the indoor coils 11 and the four-way valve 2, its location is not restricted thereto but may be in the bypass circuit 14 or elsewhere as will be exemplifed later in connection with FIG. 4.

The heat exchanger 15 uses as its heat source means a hot water boiler 18, for example, equipped with a combustor 17. Since it is intended for heating and vaporizing the refrigerant liquid that has been deprived of heat and condensed by the indoor coils 11 during heating operation, the heat exchanger 15 may use an oil burner or electric heater instead. There is no special restriction to the type of heat source means to be employed, and it is possible to utilize the waste heat from an oil burner, hot water boiler, or the like or use a regenerator that relies on inexpensive midnight power supply for the heat energy, thereby achieving a further saving of the running cost to an economic advantage. The heat exchanger 15 may be of any construction available provided that it can heat the refrigerant flowing through the refrigerant line. Where a hot water boiler as shown in FIG. 1 is used, the heat exchanger may take the form of a coil installed in the water tank 16 of the boiler, so that the refrigerant liquid is heated and vaporized as it passes through the heat exchanger 15 by the hot water in the water tank 16 heated by the combustor 17.

Numeral 35 in FIG. 1 designates a fourth bypass circuit for the heat exchanger 15. It has a solenoid valve SVF midway, in parallel to a fourth check valve 38 for interrupting the refrigerant flow from the outdoor coil 3 to the four-way valve 2. The solenoid valve SVF opens when the system operates for heating, in the heat pump fashion, on the refrigeration cycle using the outdoor coil 3 as the evaporator, allowing the refrigerant vaporized to a low pressure by the outdoor coil 3 to bypass the heat exchanger 15. Conversely, it closes when the solenoid valve SVE is opened and hence the bypass circuit 14 is made open so that the refrigerant is introduced via the bypass circuit 14 into the heat exchanger 15 for heating and subsequent circulation.

Another solenoid valve SVG is installed between the branching point 36 of the fourth bypass circuit 35 and the heat exchanger 15. Unlike the solenoid valve SVF, this valve SVG closes when the outdoor coil 3 is used as an evaporator for heat-pump operation, and opens during heating operation when the valve SVE opens and the second bypass circuit 14 is open for the circulation of the heated refrigerant.

Figure 2:
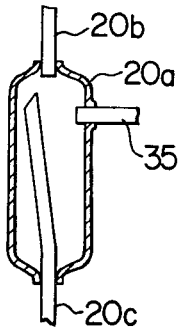
FIG. 2 is a vertical sectional view of a liquid separator as used in the embodiment of FIG. 1.

A liquid separator 20 is provided to separate the unvaporized portion from the refrigerant coming fron the heat exchanger 15 during the circulation of the heated refrigerant, recycling only the vaporized refrigerant, portion to the compressor 1. As shown in detail in FIG. 2, it consists of an enclosed casing **20*a* connected on one side with the fourth bypass circuit 35, at the top with pipe 20*b* leading to the heat exchanger 15, and at the bottom with pipe 20*c* leading to the four-way valve 2, the pipe 20*a* extending obliquely upwardly within the casing 20*a* and open at its upper end near the top of the vessel. When partly liquefied refrigerant is admitted to this separator through the pipe 20*b*, the difference in specific gravity will enable the liquid portion to drop to the bottom of the casing 20*a*,** away from the vapor portion.

Since the liquid separator 20 is installed within the water tank 16 as shown, the liquid refrigerant portion collected at the bottom will eventually be heated and vaporized by the hot water surrounding the separator 20.

As shown in FIG. 1, a capillary tube 25 is interposed between the solenoid valve SVG and the heat exchanger 15. Although it is rather desirable to dispense with it for system performance with the advantageous effects of the invention, the capillary tube or other resistor means 25 has only to be mounted when the system employs a compressor of the type which utilizes a pressure differential for supplying lubricating oil to the portions requiring lubrication or to the vane chamber, such as a commonly used rotary compressor of the slide vane type. This is because operation of the type of compressor requires the provision of at least one-third the pressure differential which is produced when the system performs a normal cooling operation or a heating operation of the heat pump cycle, if it is desired to operate the compressor without lack of lubrication or without interfering with the functioning of the slide vanes. It is only to accomplish this object that the capillary tube 25 is provided, so that the capillary tube selected for this purpose only needs to provide a pressure differential of this order to the compressor. If this is the case, the pressure of the refrigerant at the inlet of the heat exchanger 15 will generally be maintained at a level which is considerably higher than the saturation pressure of the refigerant consistent with outdoor temperature.

Where a compressor of the reciprocating piston type or other non-rotary type is adopted as the compressor 1, the capillary tube may be omitted, leaving merely the inherent piping resistance in the line between the indoor coils 11 and the heat exchanger 15.

A high-pressure control valve 19 permits the refrigerant vapor discharged from the compressor 1 to bypass and get back to the suction side of the compressor 1 when the head pressure has abnormally increased with the load variation during heat-pump operation or cooling operation, thus avoiding any irregular pressure rise and protecting the compressor against seizure.

The hot water boiler 18 is associated with a hot water supply circuit 22, which has a reducing check valve 21 at the inlet for supply of service water, a faucet 27 at the outlet, and a heat exchanger 23 midway.

The heat exchanger 23, installed within the water tank 16 of the hot water boiler 18, heats the water from a supply pipe by means of hot water in the water tank 16.

When operating the system of the foregoing construction for space heating, the operator sets the four-way valve 2 to the position indicated by full lines, closes the solenoid valves SVE, SVG, and start the compressor 1. In the manner already stated, the cooling is accomplished by circulating the refrigerant in the directions indicated by full-line arrows on an ordinary refrigeration cycle and having the refrigerant evaporated by the indoor coils 11.

For space heating, the four-way valve 2 is shifted to the position indicated by broken lines so that the refrigerant is circulated contrariwise. When the outdoor air temperature is high and the heating load is light, the solenoid valves SVE, SVG are closed and the valve SVF is opened to make the fourth bypass circuit 35 for bypassing the heat exchanger 15. Consequently the refrigerant is circulated in the directions indicated by broken-line arrows, condensed by the indoor coils 11, and then vaporized by the outdoor coil 3 to perform heating on the heat pump cycle.

As the outdoor air temperature drops and the heating load increases, the solenoid valves SVE, SVG are opened and the valve SVF closed while, at the same time, the hot water boiler 18 is switched on to heat the water inside the water tank 16 and the compressor 1 is driven. In other words, the refrigerant used as a heating medium is flown, in the directions indicated by thick hollow arrows, through the compressor 1, four-way valve 2, vapor-side stop valve 40, vapor-side solenoid valves SVB, SVC, SVD, indoor coils 11, check valves 32, liquid-side solenoid valves SVB, SVC, SVD, liquid-side stop valve 39, liquid receiver 5, second bypass circuit 14, solenoid valve SVG, capillary tube 25, heat exchanger 15, liquid separator 20, four-way valve 2, accumulator 6, and then the compressor 1, in the order of mention, and space heating is carried out by continuous heat dissipation of the heated refrigerant by means of the indoor coils 11. The release of heat by the indoor coils 11 is attributed to the heat transfer due to the change in phase of the refrigerant, i.e., from the vapor to liquid phase. The rate of heat transfer thus achieved will be very high as compared with that attained with a hot water coil.

The high-pressure liquid refrigerant, liquefied on heat dissipation by the indoor coils 11, bypass the expansion means 4 and the outdoor coil 3, flows through the second bypass circuit 14 and through the capillary tube 25 for a slight pressure drop and, liquid sealed, it runs in the form of a high-pressure liquid into the heat exchanger, where it evaporates with heat taken from the hot water in the water tank 16, and finally the refrigerant in the form of a high-pressure vapor returns to the compressor 1.

The refrigerant entering the compressor 1 maintains a high pressure because it is not subjected to such a major pressure-reducing effect as in the conventional heat pump. It is merely reduced in pressure correspondingly to the flow resistance that the refrigerant encounters during its circulation. Therefore, the refrigerant pressure has to be increased only to make up for the loss by the flow resistance, and the input is extremely small as compared with that for cooling operation or heat-pump operation. It follows that the compressor 1 need not serve as such but simply as a pump. This permits substantial reduction of the operation cost, particularly when the hot water boiler 18 uses such inexpensive heat source as kerosene.

Figure 5:
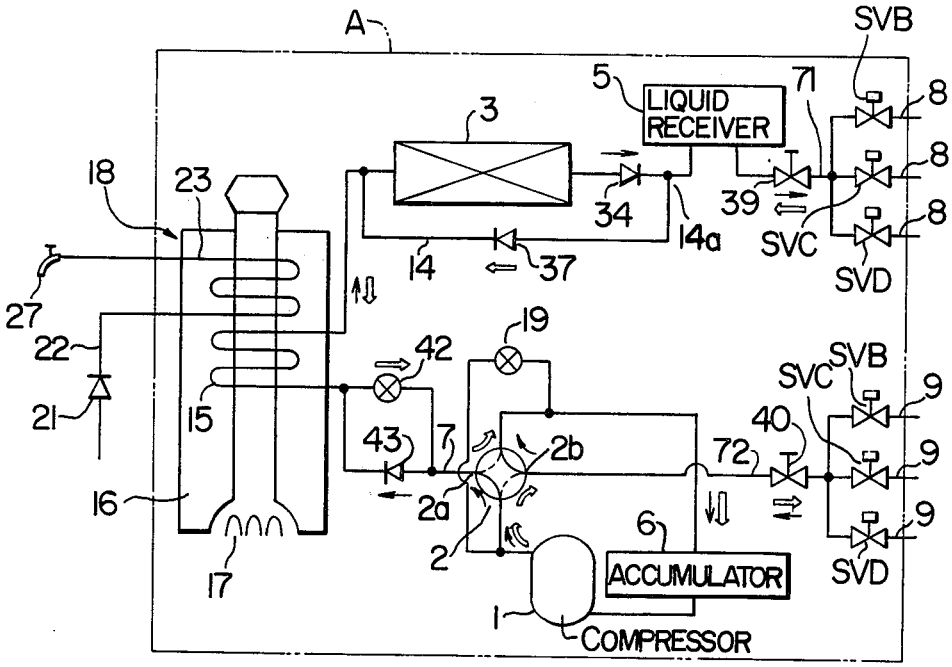
FIGS. 5 and 6 are piping diagrams of other embodiments of the invention.

While the present invention has been described as applied to a system which can be switched over to heat-pump operation or the novel heating operation in accordance with the invention, the invention is not limited thereto. In certain applications, it is possible to conduct only the novel heating operation of the invention instead of performing the heat-pump operation. FIG. 5 illustrates an embodiment of the invention for this mode of operation, which proves advantageous where a low-cost energy other than electricity is available.

The embodiment shown in FIG. 5 omits certain components of the embodiment of FIG. 1, namely, the fourth bypass circuit 35, liquid separator 20, capillary tube 25, second bypass circuit 14, solenoid valve SVE installed in the second bypass circuit, and expansion means 4. Instead, it comprises a superheat control valve 42 and a fifth check valve 43 installed between the refrigerant heat exchanger 15 and the four-way valve 2. The fifth check valve 43 is provided so that the vapor discharged from the compressor 1 during cooling operation can bypass the superheat control valve 42.

Otherwise the construction of the system is identical with that in FIG. 1, and therefore only the outdoor unit A which involves the modifications is illustrated. Throughout FIGS. 1 and 5 like numerals denote like or corresponding parts.

Thus, the system as illustrated in FIG. 5 is operated for space cooling with the four-way valve 2 in the connecting position as indicated by full lines. The refrigerant is flown through the compressor 1, four-way valve 2, fifth check valve 43, refrigerant heat exchanger 15, outdoor coil 3, third check valve 34, and liquid receiver 5, thus performing space cooling on an ordinary refrigeration cycle. During this cooling operation the heat of the discharged vapor from the compressor 1 is dissipated into the water in the water tank 16 of the hot water boiler 18, making it possible for the heated water to be utilized as the heat source for hot water supply.

For heating operation the four-way valve 2 is set to the position indicated by broken lines. Refrigerant will then flow, as indicated by thick hollow arrows, through the liquid receiver 5, second bypass circuit 14, heat exchanger 15 for the refrigerant, superheat control valve 42, four-way valve 2, accumulator 6, compressor 1, four-way valve 2, and thence vapor-side stop valve 40. In this manner heating is carried out by the circulation of heated refrigerant in accordance with the invention.

During this heating operation the superheat control valve 42 serves to sense the superheat of the refrigerant taken into the compressor 1 by suction, control the flow rate of the refrigerant in view of the second value, and maintain a constant superheat. The opening of the valve is increased or decreased according to the superheat.

Figure 6:
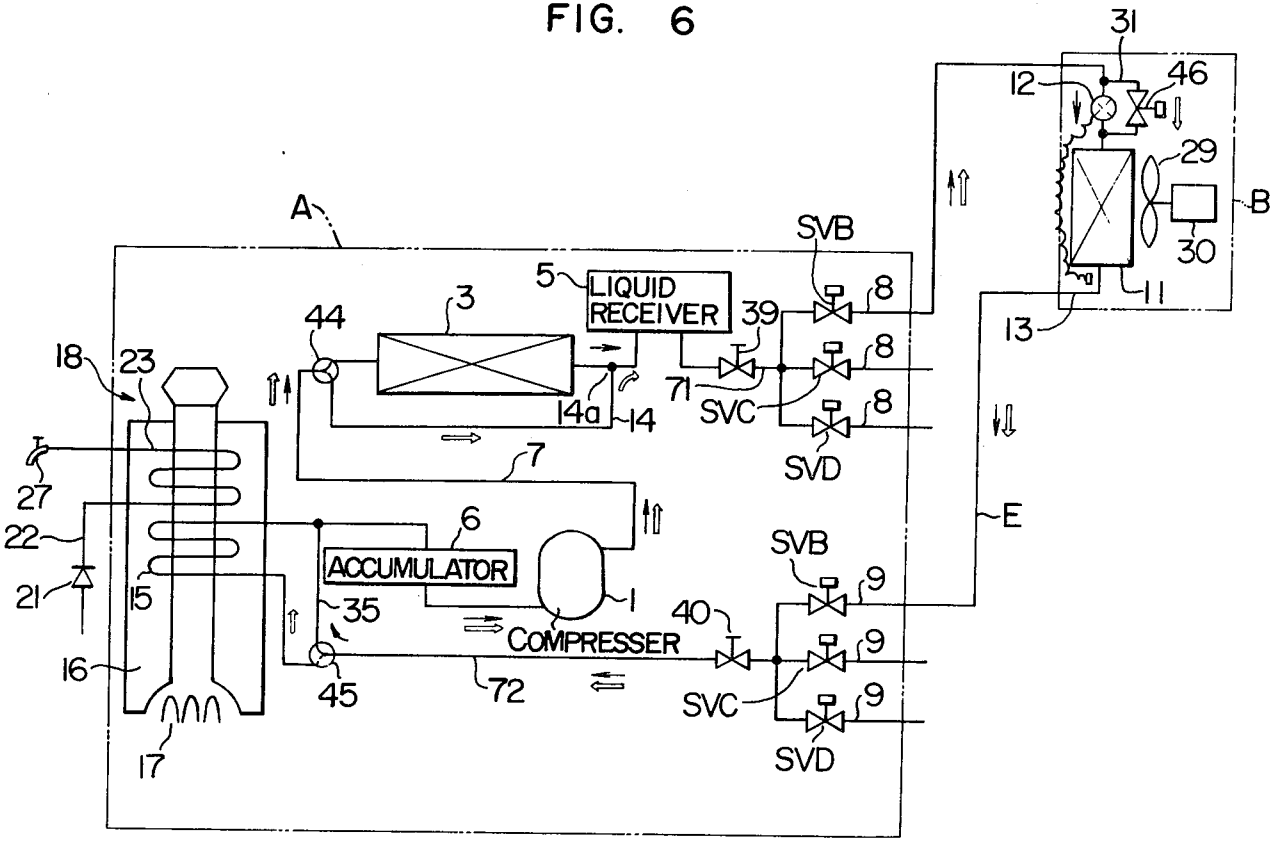

Although the embodiments described above in connection with FIGS. 1 and 5 use the four-way valve 2 as switching means for cooling operation and for heating operation with the circulation of heated refrigerant in accordance with the invention, it is not essential to install the valve. Alternatively, as shown in FIG. 6 for example, the four-way valve is omitted and, instead, the heat exchanger 15 with the fourth bypass circuit 35 in parallel is located on the suction side of the compressor 1, and the outdoor coil 3 with the second bypass circuit 14 in parallel on the discharge side of the compressor 1. At the branching points of the second and fourth bypass circuits, first and second three-way solenoid valves 44, 45 are installed, and a two-way solenoid valve 46 is provided for the first bypass circuit 31 in parallel to the expansion means 12, so that the valves 44, 45, 46 are controlled selectively for cooling or heating operation.

If the system is to operate for cooling, the three-way solenoid valves 44, 45 are set to the connecting positions as indicated by full lines and the solenoid valve 46 is closed, and then the system is switched on, causing the refrigerant to circulate in the directions of full-line arrows, for cooling operation on the known refrigeration cycle. For the heating with the circulation of heated refrigerant, the directional control valves 44, 45 are shifted to the broken-line positions and the solenoid valve 46 is opened, and then the system is started. The refrigerant will then follow the course, indicated by thick hollow arrows, through the compressor 1, three-way valve 44, second bypass circuit 14, liquid receiver 5, liquid-side stop valve 39, two-way solenoid valve 46, indoor coil 11, vapor-side stop valve 40, three-way valve 45, heat exchanger 15, accumulator 6, and back to the compressor 1. Thus, heating operation is carried out with the circulation of heated refrigerant.

The present invention provides a system of the construction and functions described herein-above. Of the inventions defined in the appended claims, the first and second inventions reside in that in a refrigerant circuit including the compressor 1, outdoor coil 3 adapted to exchange heat with outdoor air, expansion means 12, and indoor coil 11 connected together in the indicated order for performing a normal cooling operation, the heat exchanger 15, the first bypass circuit 31 bypassing the expansion means 12 and the second bypass circuit 14 bypassing the outdoor coil 3 are provided. By this arrangement, the system is capable of selectively performing a normal cooling operation and a heating operation of high efficiency and high capability. That is, when the system performs a heating operation, the first and second bypass circuits 31 and 14 are opened to allow the refrigerant to pass therethrough so as to connect the compressor 1, indoor coil 11 and heat exchanger 15 together only through the lines without the expansion means being included in the circuit. Thus, there is formed a heating circuit which is adapted to repeat the heating cycle with little resistance being offered to the flow of the refrigerant.

Accordingly, the compressor 1 operates at a higher pressure than the conventional heat pump, and the specific volume of the refrigerant vapor thus drawn in is so small that the compressor 1 can take in far more refrigerant than does the counterpart of a conventional heat pump. It will be appreciated that the compressor thus has an increased heating capacity in proportion to the raised circulation rate of the refrigerant.

Also, when the system performs a heating operation, the refrigerant of elevated temperature flowing from the indoor coil 11 to the heat exchanger 15 bypasses the outdoor coil 3. This prevents dissipation of heat through the outdoor coil 3 and renders the system economical.

Since the pressure of the refrigerant drawn in the compressor 1 is high, the compression ratio can be reduced and the power consumption of the compressor 1 is considerably lower than that of the heat pump.

Figure 3:
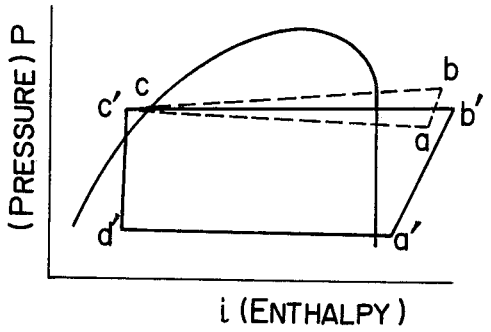
FIGS. 3 and 4 are Mollier charts illustrating heating cycles of the heating systems of the invention and of the conventional design.

The heating operation according to the invention will now be explained with reference to Mollier charts. Turning to FIG. 3, the cycle indicated by full lines, $a' - b' - c' - d'$, represents an ordinary heat-pump refrigeration cycle, whereas the cycle of the invention is represented by a broken-line triangle $a - b - c$. The compression stroke $a - b$ in the invention produces a pressure differential less than that $a' - b'$ in the heat pump operation. The condensation stroke $b - c$ is immediately followed by evaporation $c - a$, without prior expansion stroke $c' - d'$ as in the heat pump. This reduces the specific volume of the refrigerant vapor taken in the compressor and permits circulation at from 3.5 to 4 times the flow rate of refrigerant in the heat pump system.

As noted, the heating capacity in this case increases with the flow rate of refrigerant and, because the heat exchanger 15 absorbs the heat, the heating operation is not influenced by the outdoor air temperature.

The twelfth and thirteenth inventions reside in the provision of the capillary tube 25 in the line on the outdoor coil 3 side of the heat exchanger 15. In this case, the Mollier chart will be redrawn as in FIG. 4 with a modified cycle $a - b - c - d$. Although the condensation stroke $b - c$ is followed by decompression $c - d$, a heating effect similar to that achieved by the cycle shown in FIG. 3 will be attained if the pressure drop in $c - d$ is kept sufficiently small. It has been found that, if the pressure drop in $c - d$ is restricted to about one half that $c' - d'$ by the expansion means of the conventional heat pump, the quantity of refrigerant being circulated will increase about 2- to 2.5-fold. The additional heat delivered by the increased rate of circulation combines with the sufficient heat absorption by the heat exchanger 15 to confer a remarkably increased heating capacity on the system.

As has been stated, the present invention makes possible the realization of a great heating capacity with a small low-horsepower compressor and with low power consumption.

The embodiment illustrated in FIG. 6, contemplated for cooling operation on the aforedescribed concept, requires expensive three-way solenoid valves 44, 45 and two-way solenoid valve 46, respectively, in the fourth bypass circuit 35 that bypasses the heat exchanger 15, the second bypass circuit 14 that bypasses the outdoor coil 3, and the first bypass circuit 31 for bypassing the expansion means 12.

This drawback is eliminated in accordance with the second invention. As embodied in FIGS. 1 and 5, the refrigerant is reversibly flown by a four-way valve 2, so that the valves 44, 46 required for the bypass circuits 14, 31 for switching over to cooling or heating operation can be replaced by inexpensive check valves 37, 32, respectively. Also, in this case, the expansion means 12, check valve 32, and indoor coil 11 built into each of the indoor units B, C, D are interconnected in the same manner as in an indoor unit of the conventional heat-pump type air conditioning system. This means that the conventional indoor unit can be directly used with the system of the invention.

The third and fourth inventions reside in the provision, in the system of the second invention, of the liquid separator 20 and the superheat control valve 42, respectively, to be interposed between the heat exchanger 15 and the four-way valve 2, the latter sensing the degree of superheating of the gaseous refrigerant drawn by suction into the compressor and controlling the flow rate of the refrigerant so as to keep the degree of superheating constant. By the provision of these members, it is possible to prevent the refrigerant in a liquid state from returning to the compressor, thereby preventing damage to the compressor caused by compression of the refrigerant in a liquid state.

The fifth invention resides in the provision, in the system of the second invention, of the fourth bypass circuit 35 which is interposed between the inlet and outlet of the heat exchanger 15. By this arrangement the refrigerant bypasses the heat exchanger 15 when the system performs a cooling operation so as to thereby reduce the resistance offered to the flow of the refrigerant between the compressor 1 and the outdoor coil 3. This reduces the delivery pressure of the compressor and increases the operation efficiency thereof.

The sixth invention is a modification of the fifth invention in that, as shown in FIG. 1, expansion means 4 is disposed between the outdoor coil 3 and liquid receiver 5 and solenoid valves SVE, SVF are installed, respectively, in the second bypass circuit 14 and the fourth bypass circuit 35, so that opening or closing the valves SVE, SVF will selectively operate the system for the novel heating in accordance with the invention or for the usual heating on the heat pump principle. The arrangement permits the system, when using a costly heat source for the heat exchanger 15, to be switched to either heating method depending on the outdoor air temperature.

When the outdoor air temperature is not too low, the ordinary heat pump installation may exhibit required heating capacity and the heating load is light. Therefore, the system is operated in the heat pump fashion. When the outdoor air temperature is very low, however, the heat pump shows a deficiency of heating capacity despite an increased heating load. In the latter case, the system may be switched over to the novel heating operation according to the invention.

If the system embodying the first invention is designed so that the heat exchanger 15 receives heat from hot water in the hot water boiler 18 and the boiler 18 is associated with a hot water supply circuit 22, then it will be possible to use a single heat source for the dual purpose of space heating and hot water supply. This constitutes the tenth invention.

The seventh, eighth and ninth inventions are directed to the air conditioning system of the first, second and sixth invention respectively which is each constructed as a split type system wherein the system is split into an outdoor unit A and one or a plurality of indoor units B, C and D. Since the first bypass circuit bypasses only the expansion means 12 and the second bypass circuit 14 bypasses the outdoor coil 3 of the series circuit of the outdoor coil 3 and the third bypass circuit 35, there is offered the advantage of each of the indoor units B, C and D being connectable to the outdoor unit A through two lines.

The seventh, eighth and ninth inventions also cover the arrangement in which a plurality of indoor units B, C and D arranged parallel to one another are connected to the outdoor unit A through the valves SVB, SVC and SVD which can be opened and closed individually. The arrangement makes the system suitable for use as a cooling and heating system of the centrally controlled type.

The modifications offer the advantage of individual cooling or heating of a plurality of rooms by the system using a single outdoor unit A.

When the system of the invention is constructed as a central air conditioning system of a split type to serve a plurality of rooms, the cumbersome piping work for connection between the outdoor unit A and the indoor units B, C, D in separate rooms can be simplified in accordance with the invention, because the flow rate of the heating medium is low and pipes of small diameters may be used as compared with the ordinary hot water heater installations. This materially contributes to a reduction in the installation cost of the central air conditioning system.

The eleventh invention contemplates the use of a hot water boiler 18 associated with a hot water supply circuit as the heat source equipment for the heat exchanger 15 in the same way as taught by the nineth invention but for use with the system of the central control type defined in the eighth invention, thus enabling the single system to operate for the diversified duties of cooling and heating of, and hot water supply to, a plurality of rooms. The twelfth and thirteenth inventions reside in the provision of the resistor means 25 of a low resistance value which is mounted in the line connected to the heat exchanger 15 and disposed on the outdoor coil 3 side of the refrigerant circuit of the eighth and ninth inventions. By this arrangement, the system can perform a heating operation at high efficiency and high capacity irrespective of the type of the compressor used in the system. The air conditioning system provided by these inventions is of the split type as is the case with the air conditioning system provided by the eighth and ninth inventions, so that the indoor units B, C and D can be each connected to the indoor unit A through two lines.

What is claimed is:

1. An air conditioning system comprising compressor means (1) having suction side and delivery side; four-way valve means (2) having a first port connected to the suction side, a second port connected to the delivery side, a third port and a fourth port, heat exchanger means (15) for heating refrigerant passing therethrough by a heat source which is higher in temperature than outdoor air, connected to said third port of said four-way valve means (2); outdoor coil means (3) connected to said heat exchanger means (15), check valve means (34) connected to said outdoor coil means (3) permitting the refrigerant to flow from said outdoor coil means (3), expansion means (12) for cooling operation connected to said check valve mean (34), indoor coil means (11) connected to said expansion (12) and said fourth port of said four-way valve means (2), first bypass circuit means (31) bypassing said expansion means (12) and having check valve means (37) permitting the refrigerant to flow from said indoor coil means (11), second bypass circuit means (14) bypassing said outdoor coil means (3) and said check valve means (34) and having check valve means (37) permitting the refrigerant to flow from said indoor coil means (11) to said heat exchange means (15), fourth bypass circuit means (35) bypassing said heat exchanger means (15) and having check valve means (38) permitting the refrigerant to flow from said four-way valve means to said outdoor coil means (3), whereby by operating said four-way valve means (2) said system can selectively make a cooling circuit for cooling operation wherein refrigerant flows from said compressor means (1) through said four-way valve means (2), fourth bypass circuit means (35), outdoor coil means (3), check valve means (34), expansion means (12), said indoor coil means (11), and four-way valve means (2) in the indicated order, to said compressor means (1), or a heating circuit for heating operation wherein said refrigerant flows from said compressor means (1) through said four-way valve means (2), indoor coil means (11), first bypass circuit means (31), second bypass circuit (14), heat exchanger means (15) and four-way valve means (2), in the indicated order, to said compressor means (1).

2. An air conditioning system as defined in claim 1, further comprising a valve (SVE) disposed in said second bypass circuit means (14), expansion means (4) for heat pump operation bypassing said check valve means (34), and a valve (SVF) disposed in said fourth bypass circuit means in parallel relation to said check valve means (38), thereby said system further being able to form said compressor means (1) through said four-way valve means (2), indoor coil means (11), first bypass circuit means (31), expansion means (4), outdoor coil means (3), valve (SVF) of fourth bypass circuit means (35), and four-way valve means (2), in the indicated order, to said compressor means (1).

3. An air conditioning system as defined in claim 2, wherein said air conditioning system is split into an outdoor unit (A) which mounts therein the compressor means (1), four-way valve means (2), heat exchanger valve means (15), outdoor coil means (3), expansion means (4) second bypass circuit means (14), check valve (34) and fourth bypass circuit means (35), and a plurality of indoor units (B), (C) and (D) which each mount therein the indoor coil means (11), expansion means (12) and first bypass circuit means (31), and wherein said plurality of indoor units (B), (C) and (D) are arranged parallel to one another and connected to said outdoor unit (A) through valves (SVB), (SVC) and (SVD) which can be operated individually.

4. An air conditioning system as defined in claim 1, wherein liquid separator means (20) is mounted between said heat exchanger means (15) and said four-way valve means (2) whereby only the refrigerant in a gaseous state can be drawn by suction into the compressor means (1).

5. An air conditioning system as defined in claim 1, wherein a parallel circuit formed by check valve means (43) and control valve means (42) is interposed between said heat exchanger means (15) and said four-way valve means (2), said check valve means (43) permitting the refrigerant to flow from the four-way valve means (2) to the heat exchanger means (15) and said control valve means (42) sensing the degree of superheating of the refrigerant and effecting control of the flow rate of the refrigerant.

6. An air conditioning system as defined in claim 1, wherein said air conditioning system is split into an outdoor unit (A) which mounts therein the compressor means (1), heat exchanger means (15), four-way valve means (2), outdoor coil means (3) and second bypass circuit means (14), and a plurality of indoor units (B), (C) and (D) which each mount therein the indoor coil means (11), expansion means (12) and first bypass circuit means (31), and wherein said plurality of indoor units (B), (C) and (D) are arranged parallel to one another and connected to said outdoor unit (A) through valves (SVB), (SVC) and (SVD) which can be operated individually.

7. An air conditioning system as defined in claim 6 wherein resistor means (25) is mounted between the heat exchanger means (15) and the outdoor coil means (3), said resistor means (25) having a resistance value such that a predetermined pressure differential is provided between an inlet and outlet of the compressor means (1) and the refrigerant disposed at the inlet of the heat exchanger means (15) has a pressure which is above the saturation pressure of the refrigerant consistent with the outdoor temperature when the system performs the heating operation.

8. An air conditioning system as defined in claim 3, wherein resistor means (25) is mounted in a line on the side of the outdoor coil means (3) and between the heat exchanger means (15) and the fourth bypass circuit means (35), said registor means (25) having a resistance value such that a predetermined pressure differential is provided between the inlet and outlet of the compressor means (1) and the refrigerant disposed at the inlet of the heat exchanger means (15) has a pressure which is above the saturation pressure of the refrigerant consistent with the outdoor temperature when the system performs the first heating operation.

9. An air conditioning system as defined in claim 3, wherein hot water boiler means (18) is provided for heating the heat exchanger means (15), said hot water boiler means (18) being connected to hot water supply circuit means (22) so that the hot water can be utilized as a heat source for water supply.

10. An air conditioning system comprising compressor means (1), outdoor coil means (3) for exchanging heat with outdoor air, expansion means (12) and indoor coil means (11) for exchanging heat with indoor air, said means (1, 3, 12, 11) being connected in fluid flow relationship to form a circuit through which a suitable refrigerant circulates so that the system can perform a cooling operation, characterized in that said system further comprises;

heat exchanger means (15) for heating the refrigerant by a heat source which is higher in temperature than outdoor air, first bypass circuit means (31) having valve means and bypassing said expansion means (12) and, second bypass circuit means (14) bypassing said outdoor coil means (3) through valve means, thereby said system being able to form a circuit including said compressor means (1), said indoor coil means (11), said first and second bypass means (31, 14) and said heat exchanger means (15) and offering little resistance to the flow of the refrigerant therethrough, said last-mentioned circuit being used for heating operation wherein all refrigerant passing through said indoor coil means (11) flows through said heat exchanger means (15) and then is forcedly forwarded to said indoor coil means (11) by said compressor means (1) so that the heat energy of the heat source of said heat exchanger means (15) is transferred to the indoor air through said indoor coil means (11).

11. An air conditioning system as defined in claim 10, wherein hot water boiler means (18) is provided for heating the heat exchanger means (15), said boiler means (18) being connected to hot water supply circuit means (22), so that said boiler means (18) can be utilized as a heat source for hot water supply.

12. An air conditioning system as defined in claim 10 wherein said air conditioning system is split into an outdoor unit (A) which mounts therein the compressor means (1), outdoor coil means (3), second bypass circuit means (14) and heat exchanger means (15), and a plurality of indoor units (B), (C) and (D) which each mount therein the indoor coil means (11), expansion means (12) and first bypass circuit means (31) and wherein said plurality of indoor units (B), (C) and (D) are arranged parallel to one another and connected to said outdoor unit (A) through valves (SVB), (SVC) and (SVD) which can be operated individually.

* * * * *